United States Patent [19]

Ferree

[11] Patent Number: 4,727,744

[45] Date of Patent: Mar. 1, 1988

[54] DENT REMOVING TOOL

[75] Inventor: Clifford Ferree, Tampa, Fla.

[73] Assignee: Ferree' Tools, Inc., Battle Creek, Mich.

[21] Appl. No.: 931,523

[22] Filed: Nov. 17, 1986

[51] Int. Cl.[4] ..... B21B 25/00

[52] U.S. Cl. ..... 72/466; 72/478; 72/479

[58] Field of Search ..... 72/429, 466, 465, 478, 72/479, 371

[56] References Cited

U.S. PATENT DOCUMENTS

| | | | |
|---|---|---|---|
| 1,253,553 | 1/1918 | Winterhoff | 72/478 |
| 2,345,443 | 3/1944 | Aiken | 72/466 |
| 2,451,717 | 10/1948 | Check, Sr. | 72/466 |
| 2,453,531 | 11/1948 | Myers | 72/466 |
| 3,422,659 | 1/1969 | Warrick | 72/466 |

FOREIGN PATENT DOCUMENTS

| | | | |
|---|---|---|---|
| 1283167 | 12/1961 | France | 72/478 |
| 151922 | 9/1983 | Japan | 72/466 |
| 8484 | of 1896 | United Kingdom | 72/466 |
| 389862 | 7/1973 | U.S.S.R. | 72/479 |

*Primary Examiner*—Robert L. Spruill
*Assistant Examiner*—David B. Jones
*Attorney, Agent, or Firm*—Irvin L. Groh; Alfred L. Patmore, Jr.

[57] ABSTRACT

A tool for removing dents from tubing, particularly dents from curved brass tubing used in musical instruments such as trombones, trumpets and french horns. The tool is designed not only to drive a barrel-shaped dent ball past the dent to raise it, but also to reverse the procedure to remove the tool from the horn in working with tubing that is not open ended. The tool has a series of barrel-shaped force transmitting beads which are pivotally connected to each other and to a tubular handle at one end. At the other end a length of cable extends through a fixed metal driver ball to a metal retainer bead at the end of the cable. A barrel-shaped dent ball is strung on the cable for movement between the driver ball and retainer bead for impacting motion by reciprocation of the handle when the dent ball has been lodged underneath the dent to be removed.

16 Claims, 3 Drawing Figures

DENT REMOVING TOOL

This invention relates to a tool for removing dents from curved tubing, and, more particularly, a tool for removing dents in the curved tubing of musical instruments with a barrel-shaped steel dent ball which is retrieved from the instrument without the necessity for separating the curved tubing worked upon from the remainder of the instrument.

It has been a known method of removing dents in curved musical instrument tubing by forcing a metal dent ball of a spherical or barrel-shaped through the tube. In order to force the dent ball around a curve and under the dent, it was usually accomplished by shaking the tubing with a smaller metal ball against the dent ball, and quite often it was necessary to remove the curved tube from the remainder of the instrument in order to retrieve the dent ball.

An improvement over the laborious shaking process is presented in U.S. Pat. No. 2,345,443 to Aiken. Here a series of barrel-shaped dent balls of increasing size are strung onto a cable from a forward stop rearwardly to a tubular handle through which the cable is threaded and locked into place. The tool is driven into the tubing by a press or ram-rod type action forcing the successively larger dent balls or expander elements under the dent to raise it. The succession of graduated sized beads typically are driven through the tubing by hammering on the tubular handle or by a press if the instrument is held firmly in a fixture. While the use of this tool was much quicker than the shaking technique, and it provided a means of retrieving the dent ball, the quality and smoothness of the finished results is lacking over the more laborious technique of shaking a weight against the dent ball.

Another earlier attempt to provide a dent removing and tube hardening device is shown in U.S. Pat. No. 1,253,553 to Winterhoff, which has particular utility when used with tapered tubing. Here a mushroom-shaped disk of soft metal such as lead or a soft alloy which will compress is used to smooth a curved tapered surface. The disk is provided with a pilot ball of smaller diameter and smaller diameter balls are used behind the disk to drive the disk in a step by step fashion. The tubing must be mounted in an external die or mold which is clamped onto a punch press. During each downward stroke of the press, another ball is added to push the disk further into the smaller diameter tubing thus compressing the disk. It appears this is more of a smoothing type tool than an actual dent removal device. Means is provided in one embodiment to hook the successive balls together as they are fed one by one into the tubing for retrieval purposes.

Other devices have been devised to remove dents from straight or open ended tubing such as that shown in U.S. Pat. No. 3,422,659 to Warrick. Here a straightening ball is mounted on a cable behind a collar or disk and the cable is threaded through the tubing lodging the ball at the dent on one side, and the cable is pulled through from the other side. This device provides the option of a straight pressure pull or an impacting action provided by a tubular sleeve and split collar which can be applied to the free end of the cable to produce a hammering action. While this provides an impacting action by the tubular sleeve against the split collar as an anvil, the reaction at the dent ball is in the form of a steady pulling action for distending and moving the cable through the dent.

Other devices, such as those shown in U.S. Pat. Nos. 423,544 to Vanderman, 1,683,372 to Mueller et al, 2,425,298 to Attridge et al, and 2,902,078 to Fuchs, Jr. et al, show mandrel type devices which are inserted into tubing before bending to prevent the formation of dents during the bending process, but do not provide a tool for removing dents that thereafter occur.

It is a principal objective of this invention to provide a dent removing tool which utilizes a barrel-shaped dent ball in a manner that provides a better quality job over a push through or pull through device, but which provides rapid use and retrieval without the necessity for removing the tube bend from the instrument.

It is another principal object of this invention to provide a method of operating such a new tool to provide the artisan using the tool with maximum flexibility.

Further objects and advantages of the present invention will become apparent from a description of the tool which utilizes a hard metallic barrel-shaped dent ball for removing dents from curved tubing. A series of pivotally connected barrel-shaped force transmitting beads of a smaller diameter than the tube through which they will pass are used with a cylindrical handle connected to the force transmitting bead at one end of the series of beads. A metal driver ball is connected to the force transmitting bead at the other end of the series of beads. This arrangement allows repeated impacting by the driver ball against the dent ball by reciprocating the tool within the tubing. Where the tubing is curved, but open-ended, for example, a simple U-shaped trombone or baritone tuning slide, the dent ball does not have to be attached to the tool because the dent ball can be retrieved from the other open end of the tubing after it has been driven past the dent or it can be driven back under the tubing dent area by inserting the tool in the other end of the tubing. The dent ball first becomes wedged under the dent in the tubing of the driver ball progressively removes the dent, while the series of privotally connected force transmitting beads permits the travel of the tool around curves in the tubing.

In a preferred form of the invention, a length of wire cable is used having one end which is fixed to the driver and its other end extending away from the force transmitting beads with a metal retainer bead attached thereto. The barrel-shaped metal dent ball has an axial passage receiving the length of cable for movement of the dent ball relative to the cable between the driver and the retainer bead thus the cable length moves through the dent ball passage during the reciprocating impact strokes in which the driver ball impacts the dent ball. The tool is then removed from the tubing after use by impacting the retainer bead against the dent ball.

By threadingly attaching the retainer bead to the end of the cable it can be easily removed for replacement of the dent ball thereby permitting the use of successively larger size dent balls for progressive removing of the tubing dent, without the necessity for stringing an entire series of force transmitting balls on the cable.

Pivotal connection of the force transmitting balls can be provided by extending the cable from the given length beyond the driver through the series of barrel-shaped force transmitting beads and fixing it to the cylindrical handle so that the handle is brought into abuttment with the bead at one end of a series of force transmitting beads.

Tensioning of the tool is provided by making the cylindrical handle from a tube through which the cable extends and to which it can be retained by a set screw which extends through the tube into engagement with the cable.

Rigidity of the tool in the area occupied by the force transmitting beads in straight tubing, can be enhanced by the use of an adjustable sleeve extending over the portion of the handle and a number of the force transmitting beads. This sleeve is adjustable as dents in various parts of the curved tubing are operated upon. This adjustment can take the form of a series of longitudinally spaced circumferential grooves in the handle which engages one end of the adjustable sleeve.

The barrel-shaped dent ball is steel as is common in the practice. The driver ball and retention bead are also made of metal in order to provide proper impacting against the dent ball. The barrel-shaped force transmitting beads are made from nylon to prevent accidental denting by the force transmitting bead itself. The adjustable sleeve would also be made of plastic to prevent maring.

When tapered tubing is involved, such as in the case of a french horn, the force transmitting beads are made in a series of beads of a given diameter followed by another series of beads of a smaller diameter, with as many as six different progressively smaller series of beads being used to the point where the driver is attached to the cable. This permits the tool to be inserted into the tapered, curved tube to reach a dent in a small tapered portion of the tube.

In the method of using the foregoing tool, it is introduced into the instrument tubing and the dent ball is lodged under the tubing dent by inward motion of the handle impacting the drive ball against the dent ball. A reciprocating motion is applied to the tool with emphasis on the in stroke to impact the driver against the dent ball, raising the tubing dent in a series of hammer-like impacts and driving the dent ball past the dent. The tool is removed by reciprocation of the tool with emphasis on the out stroke to impact the retainer bead against the dent ball. For larger size dents, the additional step of removing the retainer ball and dent ball from the cable and replacing the dent ball with a larger size dent ball is used, in conjunction with the foregoing steps to progressively remove the dent.

The objects of this invention are accomplished by the embodiments disclosed in the following description and illustrated in the drawings in which.

Figure 1:
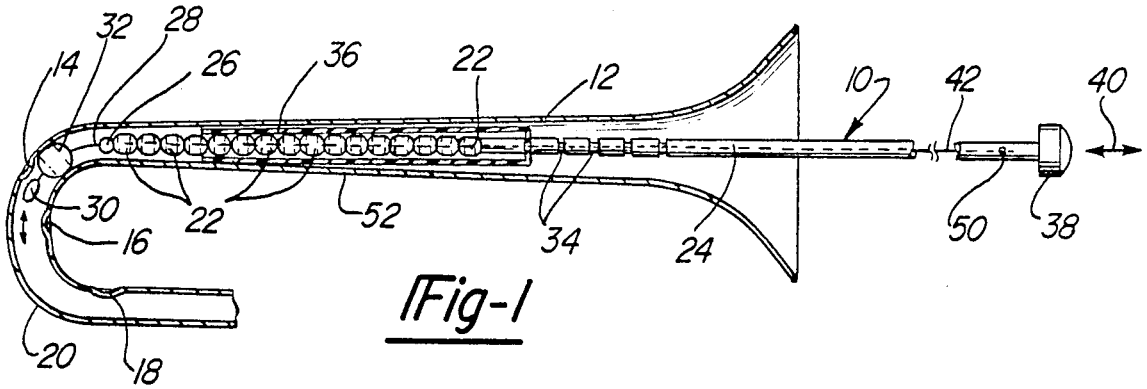
FIG. 1 is an elevational view, partially in cross-section, showing the tool of this invention inserted into the tubing of a musical instrument with the dent ball in position to be lodged under the first of a series of tubing dents.

Referrring to FIG. 1, dent removing tool 10 is shown inserted into the curved tubing of trumpet or cornet 12 to remove a series of dents 14, 16, and 18 found in the vicinity of the 180° turn section 20 of the instrument. The tool is shown as including a series of pivotally connected barrel-shaped force transmitting beads 22. These beads have a smaller maximum diameter than the tube portion 20 through which they will pass. They are of a barrel shape or oval shape design and made of nylon so that they can slip easily into the tube and around curves without damage to the tubing. A cylindrical handle 24 is connected to the force transmitting bead 22 at one end of the series of beads. A metal driver ball 26, preferably made of steel, is connected to the force transmitting bead 22 at the other end of the series of beads.

A length of wire cable 28 has one end fixed to driver 26. A metal retainer bead 30, preferably made of brass is connected to the other end of cable length 28. A barrel-shaped metal dent ball 32 is received on cable length 28 for movement relative to the cable between retainer bead 30 and driver ball 26.

Metal handle 24 has a plurality of spaced circumferential grooves to receive the end of adjustable sleeve 36 which extends over handle 24 at one end and a number of the force transmitting beads 22 at its other end. Knob 38 having a rounded end is located at the free end of handle 24 to fit into the palm the hand of the user to apply an impacting reciprocation to the tool as shown by arrow 40.

Figure 2:
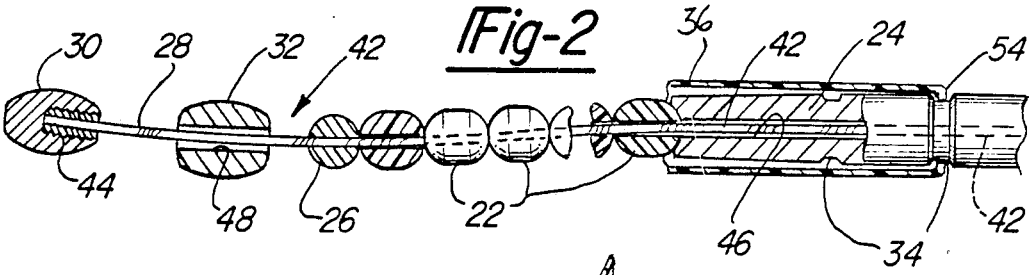
FIG. 2 is an enlarged elevational view, partially broken away showing the details of the tool of FIG. 1.

As shown in greater detail in FIG. 2, cable length 28 is a part of continuous cable 42 which extends from retainer bead 30 through central hole 46 in tubular handle 24. Threaded ferrule is swaged onto the end of cable portion 28 to threadingly engage retainer bead 30. Spherical steel driver bead 26 is also swaged onto cable 42, and internal passage 48 in barrel-shaped dent ball 32 allows the cable to move freely within the dent ball between retainer bead 30 and driver 26. In assembling the tool 10, the barrel-shaped force transmitting beads 22 are threaded over the cable 42 and the end bead 22 is in abuttment with the driver 26. The tubular handle 24 is threaded or strung over the cable 42 in abuttment with the force transmitting bead 22 at the other end of the series of beads. With the knob 38 removed, FIG. 1, the cable 42 is stretched taunt out of the end of the handle 24 to the desired degree of tension, and set arrow 50 is tightened. The excess cable is cut off and tucked into the tubing, and the knob 38 is reapplied to the end of the handle, as by set screws, not shown.

In use, the tool 10 is inserted into the tubing of the instrument 12 with the retainer bead 30 acting as a pilot. Handle 24 is pushed in by grabbing or tapping on knob 38 until the driver 26 wedges the dent ball 32 under the first dent shown at 14 in FIG. 1. The next step is to reciprocate the tool with the emphasis on the in- stroke to impact the driver against the dent ball raising the tubing dent in a series of hammer-like impacts which drives the dent ball past the dent. In the next step, the tool is removed by reciprocating the tool handle with the emphasis on the out- stroke to impact the retainer bead 30 against the dent ball.

The dent balls 32 are available in sets of up to over 100 pieces graduated in steps of 0.005 inch diameter increments. These balls are available with the tool or separately, and they have been available long prior to the present invention for use in the shaking mode described above. After removal of the tool, it may be necessary to continue with successively larger diameter dent balls until the dent has been completely removed from the instrument tubing. This is accomplished in the step of removing the threaded retainer bead 30 and sliding the previously used dent ball 32 off the cable section 28 and replacing it with the next succeeding size and reapplying the retainer bead. The foregoing steps of impacting would then be repeated for this next larger size dent ball.

In order to give the dent removing tool 10 greater rigidity when a large number of the force transmitting beads 22 remain in the straight section 52 of instrument 12, adjustable sleeve 36 can be used and would be positioned by engagement of the end flange 54 of the sleeve with and appropriate circumferential groove 34 on the tubular handle 24. Where the dent being worked upon is closer to the entering straight section 52, as the dent at 14 in FIG. 1, the sleeve 36 would be engaged with a groove 34 close to the driver end of handle 24 as shown in FIG. 1 to embrace a maximum number of force transmitting beads 22. When the dent being worked upon is around a curved portion 20, of the tubing, for example at dent 18 in FIG. 1, a number of force transmitting beads 22 would occupy the curve portion 20 so that the sleeve 36 would be adjusted to engage a groove 34 closer to the knob 38. In more complex curves or in working on dents further removed from the horn end of the instrument, the adjustable sleeve 36 would be removed and not used.

Figure 3:
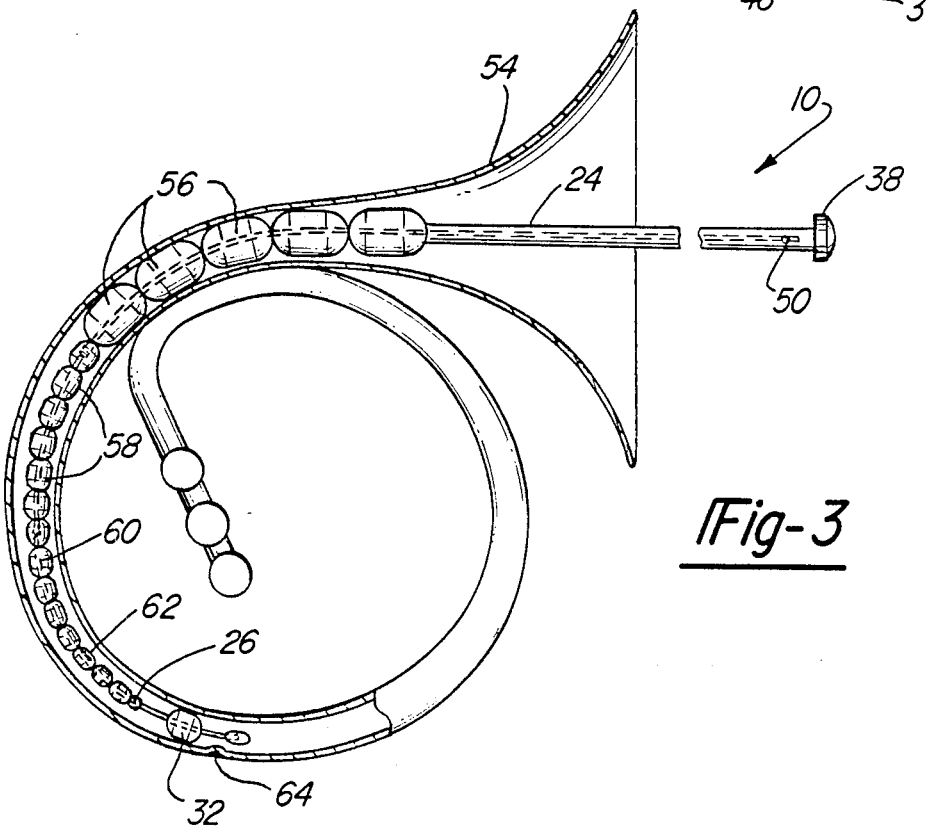
FIG. 3 is a elevational view, partially in cross-section showing another embodiment of the tool of this invention as it is applied to the curved tapering tube of a french horn showning the dent ball about to be engaged with a dent to be removed.

In the case of a musical instrument which has a tapering curved horn section such as the french horn 54 shown in FIG. 3, the force transmittng beads 22 may include several series of progressively smaller diameter beads. As shown in FIG. 3, the larger diameter beads 56 start abutting handle 24 followed with smaller diameter beads 58 still smaller beads 60, and finally the smallest diameter force transmitting beads 62, the end one of which abutts against steel driver ball 26. The operation of the tool 10 with the series of diminishing size force transmitting beads is the same as with the common size beads employed with uniform diameter curved instruments as shown in FIG. 1. That is, dent ball 64 would be first engaged with tubing dent 16 and the handle 24 reciprocated to repeatedly impact the dent ball 32 as it passes by the dent 64 raising it.

In the preferred form the force transmitting beads 22 are pivotally connected to each other by being threaded over cable 42 extending the length of the tool. Other pivotal connections of the beads could be utilized such as the poppet type connection, commonly employed in costume jewelry bead strings where a spherical projection on one side of a bead engages a spherical cavity on the adjacent bead.

It will be readily apparent that the artisan working with the dent removing tool 10 can control the force exerted with each reciporcation of the tool, and may also choose to tap on the outside of the tubing with light hammer blows as the tool is being reciporcated within the tubing. The ability to repeatedly impact the driver 26 against the barrel-shaped dent ball 32 provides quality dent removal not available with prior art devices when not utilizing an impact ball or not permitting movement of a force transmitting beads and the driver relative to the dent ball. The ability to quickly substitute a slightly larger dent ball in succeeding operations by simply unthreading the retainer bead 30 allows the artisan to gradually remove the dent in a fairly short time period. Such fine control is not possible with a series of fixed diameter dent balls which are immovably connected to each other.

The embodiments of the invention in which an exclusive property or privilege is claimed are defined as follows:

1. A dent removal tool for removing dents from curved tubing comprising, in combination:

a metal cable;

a series of barrel-shaped force transmitting beads strung on said cable, said beads having a smaller maximum diameter than the tube portion through which they will pass;

a cylindrical handle into one end of which an end of said cable extends and is attached, said handle end being in abutment with; the force transmitting bead at one end of said series of beads;

a metal driver ball rigidly attached to said cable and in abutment with the force transmitting bead at the other end of said series of beads; and a barrel-shaped metal dent ball free to move relative to said driver ball;

whereby when said barrel-shaped dent ball is inserted into said curved tubing, it can be repeatedly impacted by said driver ball by reciprocating motion of said handle within said tubing which first wedges the dent ball at the dent in said tubing, and further impacts of said driver ball progressively removes said dent, said series of force transmitting beads strung on said cable permitting travel of said tool around curves in said tubing.

2. The tool according to claim 1 wherein said wire cable extends beyond said rigidly attached driver and said force transmitting beads, further including a metal retainer bead attached to the other end of said cable; and said barrel-shaped metal dent ball having an axial passage receiving said cable between said driver ball and retainer bead for movement of said dent ball along said cable between said driver ball and said retainer bead;

whereby the cable length will move through said dent ball passage during reciprocating impact strokes in which the driver ball impacts the dent ball, and said tool can be removed from said tubing after use by impacting said retainer bead against the dent ball.

3. The tool according to claim 2 wherein said retainer bead is threadingly attached to the other end of said cable whereby it may be easily removed for replacement of said dent ball, thereby permitting the use of successively larger sized dent balls for progressive removal of the tubing dent.

4. The tool according to claim 1 wherein said cylindrical handle includes a tube through which said cable extends, said handle being retained on said cable by a set screw extending through said tube in engagement with said cable.

5. The tool according to claim 2 further comprising an adjustable sleeve extending over a portion of said handle and a number of said force transmitting beads providing rigidity of said cable in a straight portion of the tubing being repaired.

6. The tool according to claim 5 wherein said handle is provided with a series of longitudinally spaced circumferential grooves and said adjustable sleeve can be positioned so that one end thereof engages one of said grooves and the other end of said adjustable sleeve extends over a number of said series of force transmitting beads thereby providing adjustable rigidity to said tool.

7. The tool according to claim 1 wherein said force transmitting beads are made from a molded plastic material.

8. The tool according to claim 1 wherein said cylindrical handle is provided with a knob at the free end thereof.

9. The tool according to claim 2 wherein said series of force transmitting beads includes a first row of beads of a given diameter the first of which engages said driver, and a second row of force transmitting beads of a second diameter larger than said first diameter located between said first row and said handle, thereby permitting said tool to be inserted into a tapered, curved tube with said force transmitting beads being in close conformity with said tube.

10. A dent removal tool for removing dents from curved tubing comprising, in combination:

a metal cable;

a tubular handle into one end of which, said cable extends and is attached;

a series of barrel-shaped, force transmitting beads strung on said cable with the bead at one end of said series in abuttment with said handle, said beads having a smaller maximum diameter than the tube portion through which they will pass;

a metal driver ball strung on said cable and rigidly attached thereto in abutment with the last force transmitting bead in said series of beads keeping said beads in contact with each other;

a retainer bead threadly attached to the other end of said cable;

a metal barrel-shaped dent ball strung onto said cable for movement along said cable between said driver ball and said retainer bead;

whereby when said tool is inserted into a curved tube with a retainer bead being first, said cable permits said force transmitting beads to follow the curvature of said tube to the point where the dent ball becomes wedged under said dent, and said driver ball can be repeatedly impacted against said dent ball by reciprocation of said handle in the process of removing said dent until said dent ball is driven past the dented portion of said tubing, whereupon said tool may be removed by impacting of said retainer bead against said dent ball by reciprocation of said handle.

11. A tool according to claim 10 further comprising an adjustable sleeve extending over a portion of said tubular handle and over a number of said force transmitting beads to provide rigidity of said cable in a straight portion of said tube.

12. The tool according to claim 11 wherein said force transmitting beads and said sleeve are made from a plastic material to minimize the possibility of scratching or otherwise denting the tube in which it is inserted.

13. A dent removal tool for removing dents from curved, tapered tubing comprising, in combination:

a metal cable;

a tubular handle into one end of which said cable extends and is attached;

a first series of barrel-shaped, force transmitting beads strung on said cable with the bead at one end of said series in abuttment with said handle, said beads having a smaller maximum diameter than the tube portion through which they will pass;

a second series of barrel-shaped, force transmitting beads strung on said cable with the bead at one end of said series being in abuttment with the last bead of said first series of beads, and said second series of beads having a smaller maximum diameter than the maximum diameter of said first series of beads so that they can pass into a tube section of small diameter into which said first series of beads cannot pass;

a metal driver ball strung on said cable and rigidly attached thereto in abuttment with the last force transmitting bead in said second series of beads, keeping said beads of both series in contact with each other;

a retainer bead threadedly attached to the other end of said cable;

a metal barrel-shaped dent ball strung onto said cable for movement along said cable between said driver ball and said reatiner bead;

whereby when said tool is inserted, retainer bead first, into a curved tapering tube, said cable permits said force transmitting beads to follow the curvature of said tube, and said smaller diameter first series of beads passing into a tube section of smaller diameter than said second series of force transmitting beads can pass and said dent ball will become wedged under a dent, and said driver ball can be repeatedly impacted against the dent ball in the process of removing said dent until said dent ball is driven past the dented portion of said tubing, whereupon said tool may be removed by impacting of said retainer bead against said dent ball by reciprocation of said handle.

14. The tool according to claim 13 wherein said first and second series of force transmitting beads are made of nylon.

15. The method of removing dents in curved brass tubing of a musical instrument without the necessity of removing the curved tube from the remainder of the instrument, comprising the following steps:

(a) introducing a tool into the instrument tubing which tool has a central cable with a retainer bead afixed at its forward end, a driver bead afixed to the cable in spaced relationship to said retainer bead, a barrel-shaped steel dent ball strung on said cable between the retainer bead and driver ball for movement along said cable therebetween, a series of barrel-shaped force transmitting beads, and a tubular handle retaining said beads in abutment with each other and said driver;

(b) lodging said dent ball under the tubing dent by inward motion on said handle impacting said driver ball against the dent ball;

(c) reciprocating said tool with emphasis on the in stroke to impact the driver against the dent ball raising the tubing dent in a series of hammer-like impacts driving the dent ball past the dent; such emphasis not allowing impacting the retainer bead against the dent ball with enough force to dislodge the dent ball from the dent;

(d) removing said tool by reciprocating said tool with emphasis on the out stroke to impact the retainer bead against the dent ball.

16. The method according to claim 15 comprising the further steps of;

(e) removing said retainer bead and dent ball from said cable;

(f) stringing a larger diameter dent ball on said cable and replacing said retainer bead;

(g) repeating steps (a)-(d).

* * * * *